US011695206B2

(12) United States Patent
Massman

(10) Patent No.: US 11,695,206 B2
(45) Date of Patent: Jul. 4, 2023

(54) MONOLITHIC DECADE-BANDWIDTH ULTRA-WIDEBAND ANTENNA ARRAY MODULE

(71) Applicant: US Gov't as represented by Secretary of Air Force, Wright-Patterson AFB, OH (US)

(72) Inventor: Jeffrey P. Massman, Centerville, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 17/332,438

(22) Filed: May 27, 2021

(65) Prior Publication Data

US 2021/0376463 A1 Dec. 2, 2021

Related U.S. Application Data

(60) Provisional application No. 63/033,203, filed on Jun. 1, 2020.

(51) Int. Cl.
*H01Q 1/48* (2006.01)
*H01Q 3/34* (2006.01)

(52) U.S. Cl.
CPC ..... *H01Q 3/34* (2013.01); *H01Q 1/48* (2013.01)

(58) Field of Classification Search
CPC ..... H01Q 21/0087; H01Q 21/085; H01Q 21/064; H01Q 21/067; H01Q 21/24; H01Q 21/293; H01Q 1/48; H01Q 3/34; H01Q 5/25
See application file for complete search history.

(56) References Cited

U.S. PATENT DOCUMENTS

| | | | | |
|---|---|---|---|---|
| 6,356,240 | B1 | 3/2002 | Taylor | |
| 6,822,615 | B2 | 11/2004 | Quan et al. | |
| 7,180,457 | B2 | 2/2007 | Trott et al. | |
| 7,642,979 | B2 | 1/2010 | Hook et al. | |
| 7,864,130 | B2 * | 1/2011 | Deng | H01Q 1/246 343/795 |

(Continued)

OTHER PUBLICATIONS

P. J. Gibson, "The Vivaldi aerial," in 1979 9th European Microwave Conference, pp. 101-105, Sep. 1979.

(Continued)

*Primary Examiner* — Tung X Le
(74) *Attorney, Agent, or Firm* — AMCLO/JAZ; Charles R. Figer, Jr.

(57) ABSTRACT

A phased array antenna system having radiating units unitarily formed and arranged in an array by direct metal sintering avoiding assembly requirements. Each radiating unit includes a free-space impedance transformer having first, second and third radiator elements. Each radiating unit includes an embedded balun having first, second, and third impedance transition elements located generally concentric with the first, the second, and the third radiator elements and distally connected respectively to form a first integrated coaxial interface, a second integrated coaxial interface, and an integrated ground interface. Each radiating unit includes a ground plane electrically coupled to the integrated ground interface.

4 Claims, 7 Drawing Sheets

(56) References Cited

U.S. PATENT DOCUMENTS

| | | | | |
|---|---|---|---|---|
| 8,736,505 | B2 | 5/2014 | Lambert et al. | |
| 9,270,027 | B2 | 2/2016 | Waschenko et al. | |
| 10,027,030 | B2 | 7/2018 | Boryssenko et al. | |
| 10,320,075 | B2 | 6/2019 | Sanchez | |
| 2013/0214980 | A1* | 8/2013 | Lambert | H01Q 13/085 343/771 |
| 2015/0123864 | A1* | 5/2015 | Boryssenko | H01Q 9/16 343/816 |
| 2016/0072191 | A1 | 3/2016 | Iwai et al. | |
| 2016/0294065 | A1* | 10/2016 | Lindmark | H01Q 21/28 |
| 2017/0062925 | A1* | 3/2017 | Sanchez | H01Q 3/26 |
| 2020/0321708 | A1* | 10/2020 | Shi | H01Q 23/00 |

OTHER PUBLICATIONS

H. Holter, "A new type of antenna element for wide-band wide-angle dual polarized phased array antennas," in IEEE International Symposium on Phased Array Systems and Technology, 2003., pp. 393-398, Oct. 2003.

R. W. Kindt and W. R. Pickles, "Ultrawideband all-metal flared-notch array radiator," IEEE Transactions on Antennas and Propagation, vol. 58, pp. 3568-3575, Nov. 2010.

J. Yan, S. Gogineni, B. Camps-Raga, and J. Brozena, "A dual-polarized 2-18-ghz Vivaldi array for airborne radar measurements of snow," IEEE Transactions on Antennas and Propagation, vol. 64, pp. 781-785, Feb. 2016.

J. T. Logan and M. N. Vouvakis, "A low cross-polarization decade-bandwidth Vivaldi array," in 2015 IEEE International Symposium on Antennas and Propagation USNC/URSI National Radio Science Meeting, pp. 2519-2520, Jul. 2015.

J. T. Logan and M. N. Vouvakis, "Decade-bandwidth low cross-polarization UWB array," in 2016 IEEE International Symposium on Antennas and Propagation (APSURSI), pp. 437-438, Jun. 2016.

T. G. Spence and R. Rodriguez, "Additively manufactured ultrawideband, wide scan, monolithic Vivaldi arrays," in 2017 IEEE International Symposium on Antennas and Propagation USNC/URSI National Radio Science Meeting, pp. 1239-1240, Jul. 2017.

J. Massman, B. Simpson, and T. Steffen, "Low cost additively manufactured antenna array modules," in 2019 IEEE International Symposium on Phased Array Systems and Technology (PAST), pp. 1-4, Oct. 2019.

* cited by examiner

MONOLITHIC DECADE-BANDWIDTH ULTRA-WIDEBAND ANTENNA ARRAY MODULE

CROSS-REFERENCE TO RELATED APPLICATIONS

This application claims the benefit of priority under 35 U.S.C. § 119(e) to U.S. Provisional Application Ser. No. 63/033,203 entitled "Monolithic Decade-Bandwidth Ultra-Wideband Antenna Array Module," filed 1 Jun. 2021, the contents of which are incorporated herein by reference in their entirety.

ORIGIN OF THE INVENTION

The invention described herein was made by employees of the United States Government and may be manufactured and used by or for the Government of the United States of America for governmental purposes without the payment of any royalties thereon or therefore.

BACKGROUND

1. Technical Field

The present disclosure relates generally to antenna arrays and more specifically relates to a notch-antenna array and a method of making same.

2. Description of the Related Art

Many applications, such as radar and communication systems, require a method for converting electrical signals to propagating waves in free-space. The apparatus used for this purpose is called an antenna, which may function to both transmit and receive wireless signals. A description of the operation of an antenna may be generally understood in terms of either transmission or reception, with the other operational mode being implied as inherent therein. The antenna is essentially a transducer and is commonly referred to by those skilled in the field as a radiator or radiating element. Certain applications additionally require the ability to rapidly scan the antenna beam; where the antenna beam is defined as the spatially dependent radiated field for signal transmission. A type of antenna with this capability is commonly referred to as a phased-array antenna.

A phased-array antenna includes a plurality of radiating elements in which the relative phases of respective signals feeding the antennas are set in such a way that an effective radiation pattern of the array is reinforced in a desired direction and suppressed in undesired directions. The phase relationships among the elements may be fixed or adjustable. Similarly, the direction of arrival for a received signal may be determined based on the configuration of radiating elements. The antenna array is generally understood to be comprised of a three-dimensional, or non-planar, arrangement with a plurality of radiating elements. Many antenna arrays preclude the third dimension and extend exclusively along one or two dimensions (i.e. linear or planar arrays). Each antenna element of the array may be excited with a signal of identical or adjusted phase and amplitude to accomplish the desired radiation pattern as determined by someone skilled in the art.

BRIEF SUMMARY

In one aspect, the present disclosure provides a phased array antenna system includes more than one radiating unit arranged in an array. Each radiating unit includes a free-space impedance transformer having first, second and third radiator elements. Each radiating unit includes an embedded balun having first, second, and third impedance transition elements located generally concentric with the first, the second, and the third radiator elements and distally connected respectively to form a first integrated coaxial interface, a second integrated coaxial interface, and an integrated ground interface. Each radiating unit includes a ground plane electrically coupled to the integrated ground interface.

In another aspect, the present disclosure provides a method including direct metal laser sintering of more than one radiating unit arranged in an array beginning at distal tips of free-space impedance transformers of the more than one radiating unit. The method includes direct metal laser sintering of a balun having first, second, and third impedance transition elements concentric respectively within first, second, and third radiator elements of each respective radiator unit. The method includes direct metal laser sintering a proximal connection respectively of the first, the second, and the third impedance transition elements to the first, the second, and the third radiator elements of each respective radiator unit to form a first integrated coaxial interface, a second integrated coaxial interface, and an integrated ground interface. The method includes direct metal laser sintering an integral ground plane to the integrated ground interfaces of the more than one radiating unit.

The above summary contains simplifications, generalizations and omissions of detail and is not intended as a comprehensive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figures 1A, 1B, 1C:
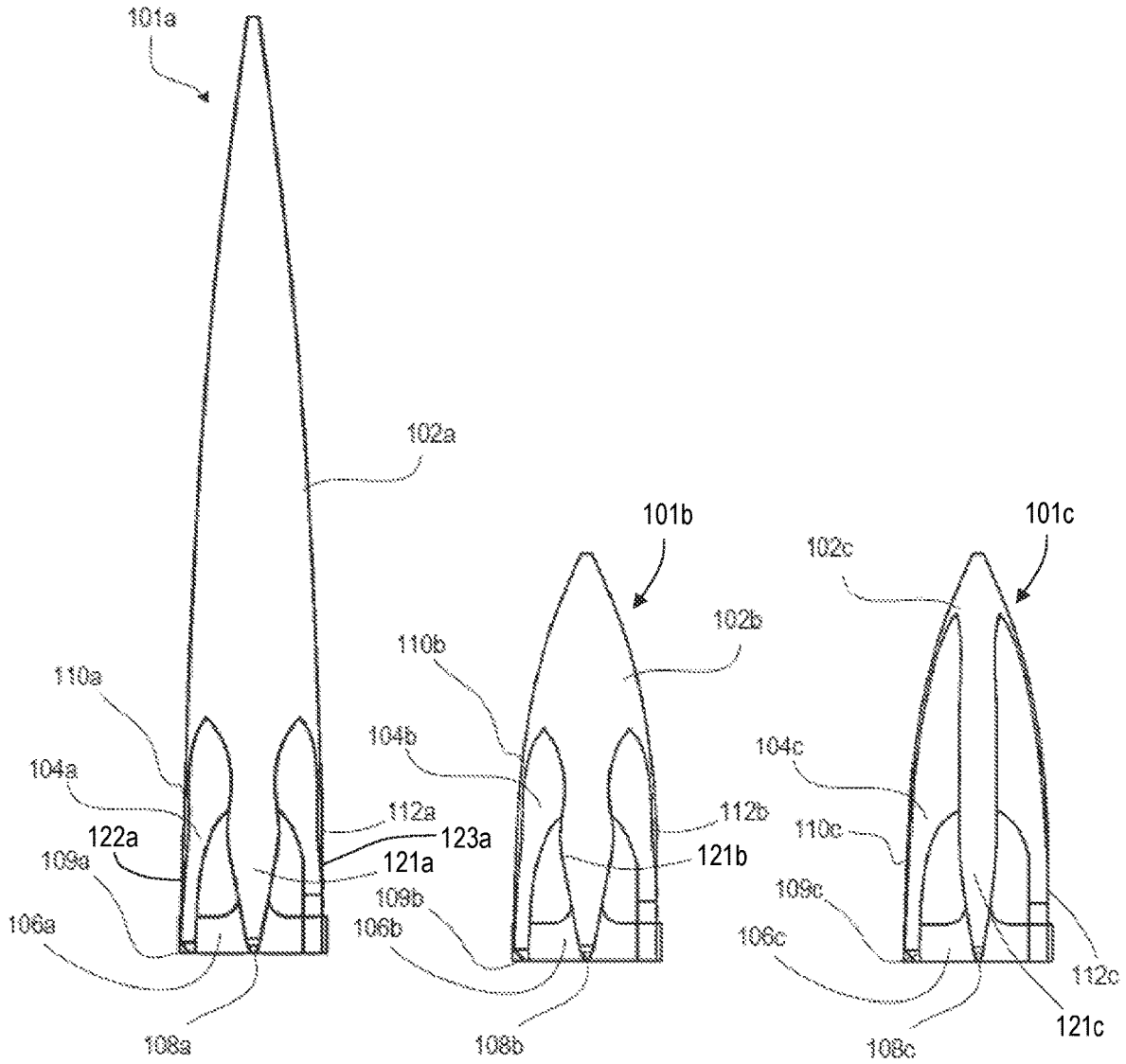
FIG. 1A depicts a side view of a first example phased-array system radiating element, according to one or more embodiments.
FIG. 1B depicts a side view of a second example phased-array system radiating element, according to one or more embodiments.
FIG. 1C depicts a side view of a third example phased-array system radiating element, according to one or more embodiments.

A notch-antenna array system module including at least one element that is formed as a monolithic electrically conductive structure comprises an integrated coaxial interface, ground plane, balun, and free-space impedance transformer. The system module precludes the need for additional RF connectors and includes a seamlessly integrated structure configured to propagate radio frequency signal to and from the respective antenna transformer elements of the monolithic array module. The system module also may include an embedded balun and coaxial interface configured such that the impedance transition elements are located generally concentric with the radiator elements of a singular unit cell.

The present innovation enables manufacturing and use of a phased-array antenna system including a plurality of radiating elements not limited to a planar dimension. While the innovation will be described in connection with certain embodiments, it will be understood that the invention is not limited to these embodiments. To the contrary, this invention includes all alternatives, modifications, and equivalents as may be included within the spirit and scope of the present innovation.

According to one embodiment of the present innovation radiating elements for a phased-array system comprise a plurality of radiating elements along one or two planar or non-planar dimensions to form an antenna array. The specific arrangement of radiating elements can be periodic with a specified lattice or aperiodic in order to achieve the desired performance for a radar or communication system. The phased-array radiating element includes an integrated coaxial interface, ground plane, balun, and free-space impedance transformer with the embedded balun arranged such that the coaxial interface, balun, and impedance matching features are located generally concentric with the radiator elements of a singular unit cell. The phased-array antenna system may be monolithically fabricated and dimensionally reconfigured to support the radiation of a specified frequency range of propagation signals.

Another embodiment illustrates a phased-array antenna system with planar and non-planar interfacing apparatuses. The phased-array antenna system may be configured to interface directly with a planar or vertical apparatus, such as a printed circuit board or transceiver module. Alternatively, the system may include a plurality of embedded coaxial RF structures compatible with interfacing directly with standard RF connectors. The example embodiments preclude the need for additional RF interfaces, such as connectors or fuzz buttons, between the phased-array antenna system and the interfacing radar or communication system hardware. The phased-array antenna system may be fabricated monolithically or as segmented sections in order to enable integration of the embodiment into a radar or communication system.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations described herein and in the appendices to this provisional application.

The present innovation relates to phased-array antennas for radar and communication systems and specifically to notch-antenna array modules with at least one radiating element comprising an integrated coaxial interface, ground plane, balun, and free-space impedance transformer. The present innovation may be formed as a single, monolithic structure comprised of an electrically conductive material. In one alternative, the invention may be formed with a non-conductive material and subsequently metalized through processes such as but not limited to vapor deposition, electroless, and electrolytic plating. The notch-array module may be fabricated monolithically through additive manufacturing, investment casting, injection molding, compression molding or alternative methods compatible with the geometrical complexity and dimensional requirements of the present innovation.

The present disclosure provides a balun that converts the coaxial input connector into the balanced flared notch radiators. Conventional Vivaldi antennas are fed with a Marchand balun. However, Marchand baluns typically have a significant horizontal section that is not amendable to the flared angles required for self-supporting DMLS structures. Therefore, we chose to use a tapered transmission line balun such that the flared notch is excited by simply connecting the outer conductor and inner conductor of the coax feed to the two Vivaldi arms. Another modification from classical Vivaldi antennas is the ground plane. The outer conductor of the coax feed is swept outwards at a near 45o angle to generate the ground plane. In contrast, conventional ground planes are horizontal which helps maximize the open volume of the Marchand balun and thus maximizes the bandwidth. Our ground plane skirt does slightly degrade the low frequency impedance match compared to an ideal horizontal ground plane. An advantage of our printed ground plane is the simple manufacturing since the printed ground plane is naturally electrically connected to the antenna elements. In contrast, it is common for traditional Vivaldi arrays to require hand soldering or conductive paste to connect the antenna elements to the ground plane.

FIG. 1A depicts a side view of a first example phased-array system radiating unit 101*a* ("single unit cell") having a free-space impedance transformer 102*a*, embedded balun 104*a*, ground plane 106*a*, and integrated coaxial interfaces 108*a*-109*a*. In one or more embodiments, the radiating unit 101*a* is configured with radiator elements 110*a*-112*a* that connect respectively to the integrated coaxial interfaces 108*a*-109*a* and the ground plane 106*a*. The embedded balun 104*a* having impedance transition elements 121*a*-123*a* is located generally concentrically respectively within the radiating elements 110*a* 112*a* of the free-space impedance transformer 102*a*. First impedance transition element 121*a* of balun 104*a* is communicatively connected to the integrated coaxial interface 108*a*. Second impedance transition element 122*a* of balun 104*a* is communicatively connected to the integrated coaxial interface 109*a*. Third impedance transition element 123*a* of balun 104*a* is communicatively connected to the integrated ground plane 106*a*. The two integrated coaxial interfaces 108*a*-109*a* are each physically placed along adjacent sides to support orthogonal electromagnetic polarization components of the propagating signal.

The radiating unit 101*a* of the present innovation may be configured with a specified arrangement of features and dimensions, as determined by one skilled in the art, to achieve a particular range of electromagnetic wave signals for radar and communication applications. FIGS. 1B-1C are side views of second and third a second example phased-array system radiating units 101*b*-101*c* respectively. Radiating units 101*b*-101*c* have like components to FIG. 1A referenced with the same reference numeral but with a corresponding suffice "a" or "b" respectively to denote the different dimensions. The monolithic structure of the radiating unit 101*a* may include a seamless surface finish or plurality of holes perforating the sidewalls. The specific arrangement of holes may be determined by one skilled in the art in order to reduce the phased-array system weight without impacting electromagnetic performance.

Figure 2:
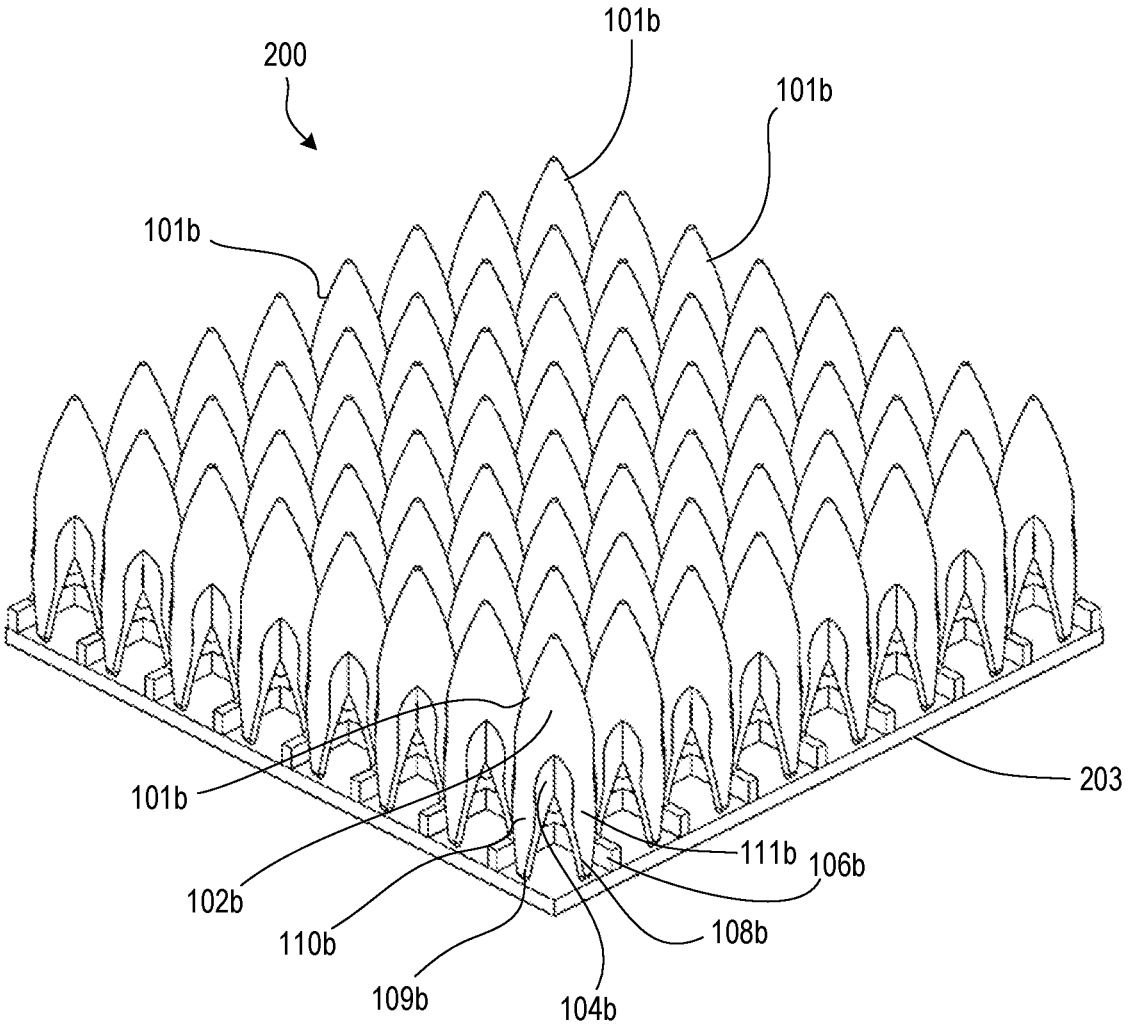
FIG. 2 depicts a three-dimensional view of a phased-array antenna system with a planar interfacing apparatus, according to one or more embodiments.

FIG. 2 illustrates a phased-array antenna system 200 with a planar interfacing apparatus 203. The phased-array antenna system 200 consists of a plurality of radiating units 101*b* along one or two planar dimensions to form an antenna array. The specific arrangement of radiating elements 101*b* can be periodic with a specified lattice or aperiodic in order to achieve the desired performance for a radar or communication system. Specifically, the embodiment illustrates how the phased-array antenna system 200 may be configured to interface directly with a planar structure, such as a printed circuit board. Such an interface configuration may be permitted through manufacturing processes such as but not limited to solder preforms, conductive epoxies, and solder paste. The example embodiment precludes the need for additional RF interfaces, such as connectors or fuzz buttons, between the phased-array antenna system and the interfacing radar or communication system hardware.

Figure 3:
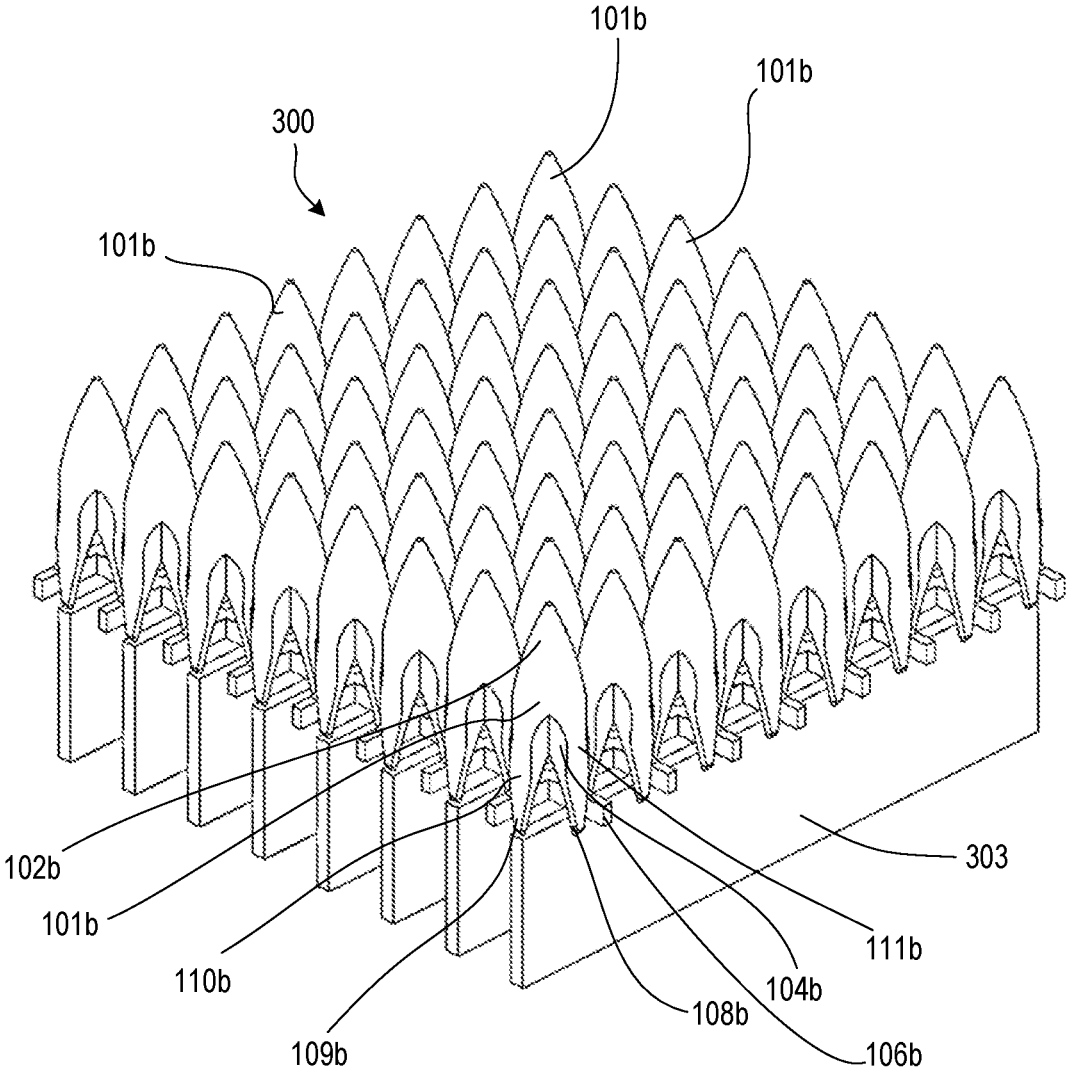
FIG. 3 depicts a three-dimensional view of a phased-array antenna system with a vertical interfacing apparatus, according to one or more embodiments.

FIG. 3 illustrates a phased-array antenna system 300 with a vertical interfacing apparatus 303. The phased-array antenna system 300 consists of a plurality of radiating units 101*b* along at least one dimension to form an antenna array for planar or non-planar (i.e. conformal) embodiments. The specific arrangement of radiating elements 101*b* can be configured as periodic with a specified lattice or aperiodic, as dictated by the radar or communication system performance specifications. As an example, the embodiment illustrates how the phased-array antenna system may be configured to interface directly with a plurality of vertical structures, such as a printed circuit board or signal transceiver module. Such an interface configuration may be permitted through manufacturing processes such as conductive epoxies and solder paste. The example embodiment precludes the need for additional RF interfaces, such as connectors or fuzz buttons, between the phased-array antenna system 300 and the interfacing radar or communication system hardware.

Figure 4:
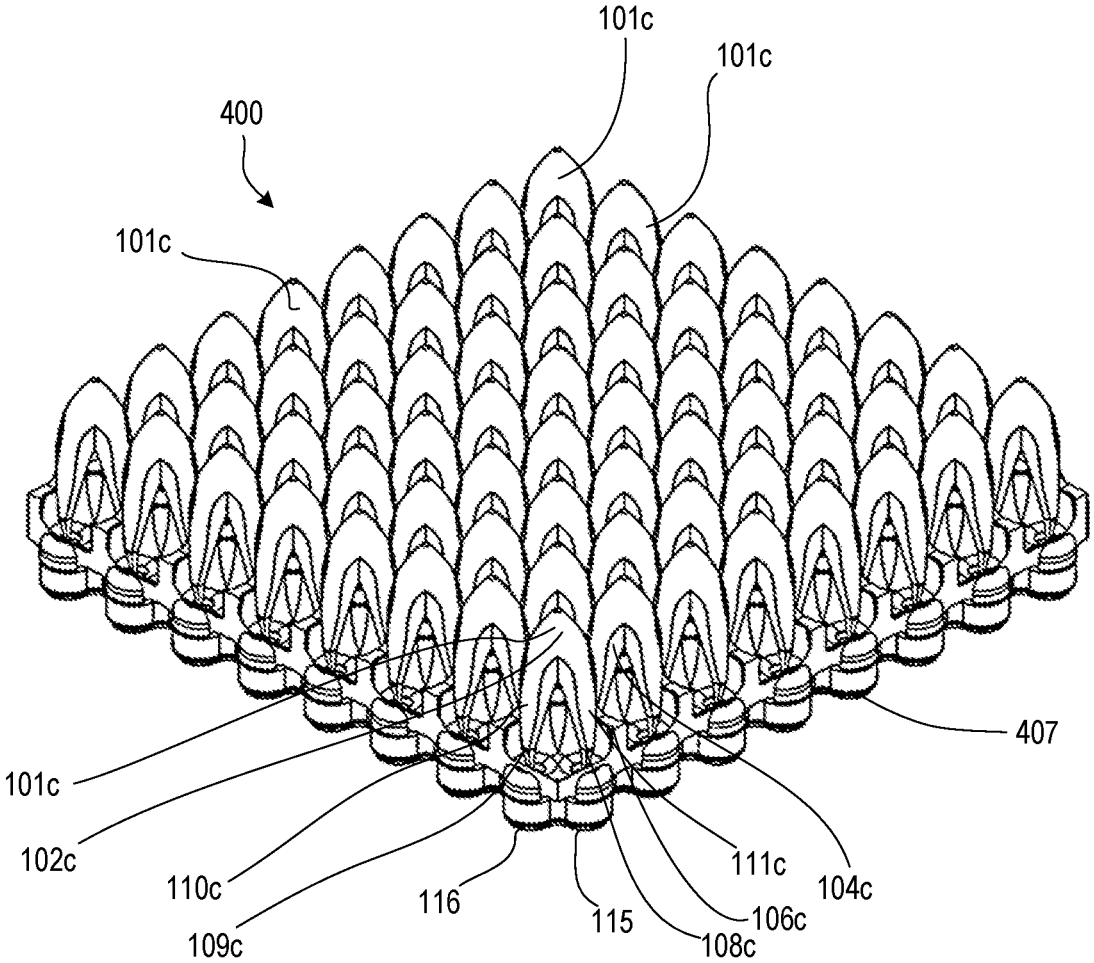
FIG. 4 depicts a three-dimensional view of a phased-array antenna system with embedded coaxial connectors, according to one or more embodiments.

FIG. 4 illustrates a phased-array antenna system 400 with embedded coaxial connectors 115-116 in a coaxial interfacing apparatus 407. The phased-array antenna system 400 consists of a plurality of radiating units 101*c* along at least one dimension to form an antenna array for planar or non-planar (i.e. conformal) embodiments with a radiating element arrangement comprising either periodic or aperiodic lattices in order to achieve the desired performance for a radar or communication system. The example embodiment illustrates how the phased-array antenna system may be configured with embedded RF connector interfaces that are coupled to embedded coaxial connectors 115-116 respectively. This embodiment precludes the need for additional RF interfaces between the phased-array antenna system 400 and the interfacing radar or communication system hardware. In particular, the invention permits a directly accessible coaxial RF connection at each radiating element and polarization component of the phased-array antenna system 400.

Figure 5A:
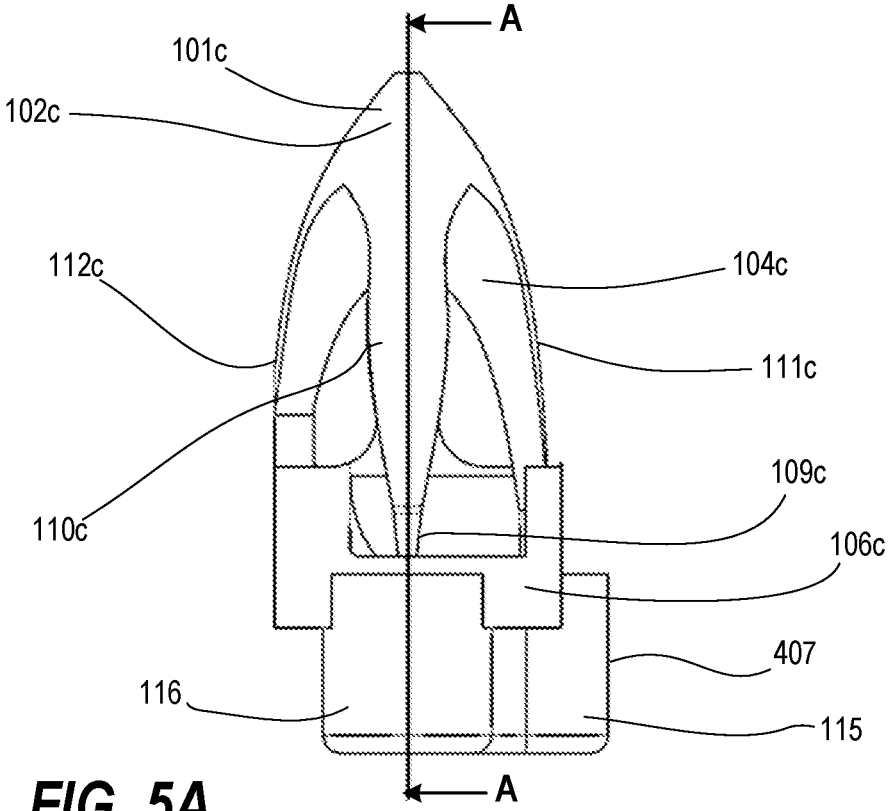
FIG. 5A depicts a side view of a phased-array antenna element of FIG. 4, according to one or more embodiments.
Figure 5B:
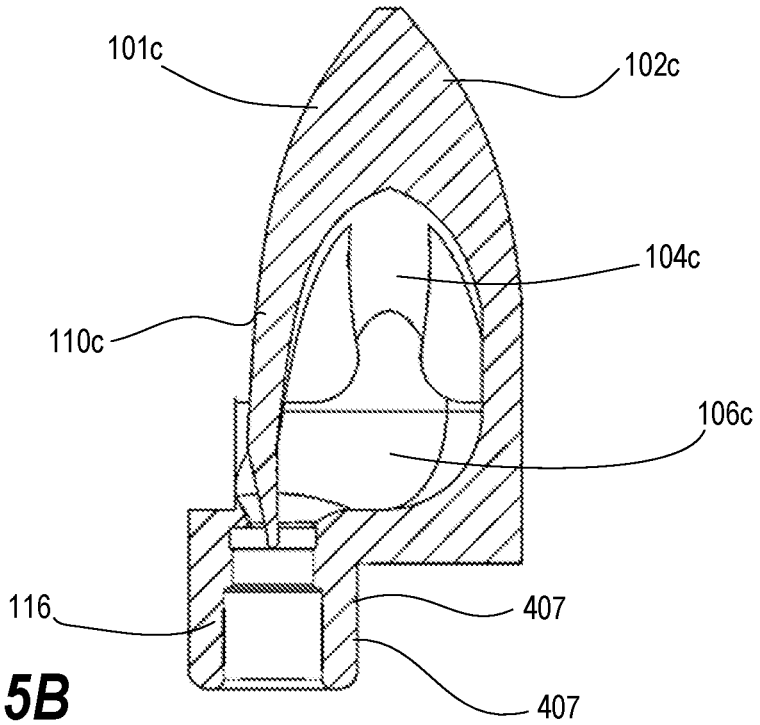
FIG. 5B depicts a side cross sectional view of the phased-array antenna element of FIG. 5A, according to one or more embodiments.

FIG. 5A depicts a side view of the phased-array antenna unit 101*c* that is incorporated with the coaxial interfacing apparatus 407. FIG. 5B depicts a side cross sectional view of the phased-array antenna unit 101*c*. FIG. 5 illustrates a detailed cross-section for the embedded coaxial connector embodiment. The embodiment consists of an embedded connector structure extending out from the radiating element along the bottom side of the phased-array antenna system. The structure is formed monolithically with features present at each coaxial center conductor and adjacent conductive sidewalls such that the structures interface directly with compatible standard RF connectors, such as but not limited to SubMiniature version A (SMA) or Sub-Miniature Push-on Micro (SMPM). The embedded coaxial connector structure may be dimensionally reconfigured to accommodate particular mechanical loads and compressions with dimensional tolerances specified as appropriate.

Figure 6:
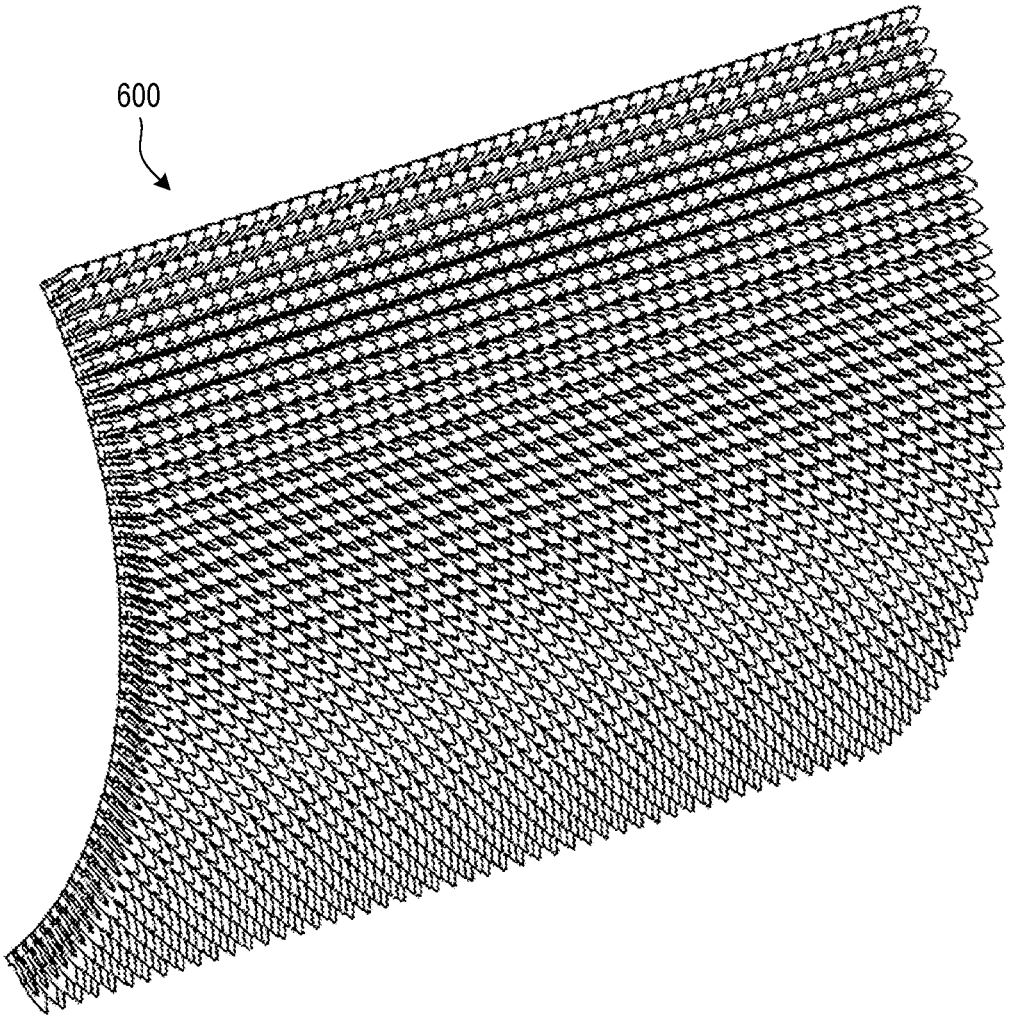
FIG. 6 depicts a three-dimensional view of an example non-planar phased-array antenna system, according to one or more embodiments.

FIG. 6 illustrates an example embodiment of a non-planar phased-array antenna system 600. The phased-array antenna system 600 consists of a plurality of radiating elements 601 extending along one or two non-planar (i.e. conformal) dimensions. The non-planar phased-array antenna system 600 may include a combination of features for an RF interfacing apparatus, either wholly or in part, as illustrated in the example embodiments from FIG. 2, FIG. 3, and FIG. 4. The plurality of radiating elements may be reconfigured to achieve a periodic or aperiodic lattice as determined by the application and performance specifications. The embodiment may be fabricated monolithically or as segmented sections in order to facilitate integration of the non-planar phased-array antenna system into the overall radar or communication system and mechanical integration apparatus (such as but not limited to an aircraft panel).

PROTOTYPES: A modular, end-fire, dual-polarized ultra-wideband scalable array (MEDUSA) was introduced that was realized exclusively with direct metal laser sintering (DMLS) to achieve a connector-less phased array antenna module. The radiator is based on a variation of conventional tapered slot antennas (i.e. Vivaldi) to achieve an all metal fully-monolithic element consisting of RF coaxial interface, balun, and free-space transformer. A very low-cost array module is achieved by adapting the design uniquely to the fabrication process in order to eliminate nearly all post-processing. A finite 8×8 array covering 7-21 GHz has been prototyped and measured to demonstrate agreement in active impedance and element patterns.

Introduction: Modern active electronically scanned array (AESA) systems generally support multifunctional, shared-aperture operations such as radar and multiple-input, multiple-out (MIMO) communication systems. These diverse functional requirements lead to AESA systems that must maintain ultra-wideband (UWB) operation over wide-scan angles with polarization agility. High-profile notch or Vivaldi based antenna architectures have remained popular solutions for these sensor applications due to its ability to cover operational bandwidths in excess of 10:1 over wide scan volumes with a simple 50-ohm coaxial feed [1]—[4]. Vivaldi antenna arrays continue to receive interest as researchers seek to improve various performance or fabrication complexities associated with the design [5]—[7]. Recent advances have also demonstrated a low cost UWB array module with connector-less phased array radiating element realized with stereolithography (SLA) [8].

The metallized SLA MEDUSA antenna architecture is extended to titanium DMLS as an alternative prototyping process to achieve a mechanically robust, low-cost UWB antenna array. The present disclosure briefly reviews the design for the modular, end-fire, dual-polarized ultra-wide-band scalable array (MEDUSA). Then, a fully-monolithic all metal titanium element consisting of a 50-ohm coaxial interface, balun, and free-space transformer are be shown which completely eliminates the need for additional RF connectors or alternative interconnects. This titanium DMLS design realizes the advantages of rapid manufacturing and provides substantial cost savings for high power phased array antennas.

Element Design: The conventional approach to feeding Vivaldi antennas utilizes the Knorr balun for a wideband transition from an unbalanced feed to a balanced slot line radiator. This feed geometry generally consists of the unbalanced feed structure routed out and around the cavity structure to terminate into a 50-ohm coaxial connector at the antenna element base. The standard method unnecessarily increases the transition routing complexity and a modified feed method was introduced in [8]. This new feed method shifts the balun location up and around the parallel line feed arms and allows the impedance transition elements to be concentric with the radiator elements. The approach reduces the DMLS structure complexity and will readily scale into millimeter wave bands.

The presented element realized with titanium DMLS accommodates both the printer dimensional tolerances and post-processing requirements (i.e. support structures, build platform removal, etc.) with the inclusion of two 50-ohm embedded SMPM (GIIPO) coaxial connectors. This design eliminates the need for additional RF connectors by printing two modified SPMP connectors directly into the array module. The modified feed geometry attempts to ideally trade-off the geometric requirements for successfully mating to the SMPM connector while also providing a mechanically robust feed pin. This effectively reduces both the materials cost and assembly integration times to achieve a very low cost phased array antenna module.

Predicted and Measured Results: Simulations and measurements demonstrate the performance to be comparable to conventional PCB fabricated Vivaldi antenna arrays. The presented titanium DMLS MEDUSA element (8 mm×8 mm×12 mm unit cell size) covers 7-21 GHz operation, though may be scaled to other frequency bands and operational bandwidth ratios. A prototype module consisting of 8×8 elements was fabricated and measured to validate the DMLS MEDUSA architecture. This initial prototype was developed with a Concept Laser M2 machine with titanium (Ti 6Al-4V) at 30 um layers to achieve the necessary geometric tolerances with a 300 micro-inches Ra surface roughness. Secondary plating may be applied as needed to increase the surface conductivity. The design achieves low VSWR for wide scan angles in all planes. This predicted performance is comparable to conventional PCB Vivaldi antennas in terms in operational bandwidth, scan volume, VSWR, and polarization purity.

Embedded element patterns were measured using a near-field scanner with boresight realized swept gain for the center most element of the array and compared to predictions for a planar array. At broadside radiation, more than a 3:1 bandwidth is achieved (7-21 GHz). For this operational frequency range the active VSWR is 2.0 or better and the realized embedded element gain correlates to within +/−2 dB the theoretical ideal. The co-polarization and cross-polarization measured patterns for E-plane and H-plane cuts and demonstrate stable patterns across the operational bandwidth. All measurements include some variation due to finite array effects as well general measurement setup and fabrication tolerance errors.

The cited reference numbers refer to the following reference documents that are hereby incorporated by reference in their entirety:

[1] P. J. Gibson, "The Vivaldi aerial," in 1979 9th European Microwave Conference, pp. 101-105, September 1979.

[2] H. Holter, "A new type of antenna element for wide-band wide-angle dual polarized phased array antennas," in IEEE International Symposium on Phased Array Systems and Technology, 2003., pp. 393-398, October 2003.

[3] R. W. Kindt and W. R. Pickles, "Ultrawideband all-metal flared-notch array radiator," IEEE Transactions on Antennas and Propagation, vol. 58, pp. 3568-3575, November 2010.

[4] J. Yan, S. Gogineni, B. Camps-Raga, and J. Brozena, "A dual-polarized 2-18-ghz Vivaldi array for airborne radar measurements of snow," IEEE Transactions on Antennas and Propagation, vol. 64, pp. 781-785, February 2016.

[5] J. T. Logan and M. N. Vouvakis, "A low cross-polarization decade-bandwidth Vivaldi array," in 2015 IEEE International Symposium on Antennas and Propagation USNC/URSI National Radio Science Meeting, pp. 2519-2520, July 2015.

[6] J. T. Logan and M. N. Vouvakis, "Decade-bandwidth low cross-polarization UWB array," in 2016 IEEE International Symposium on Antennas and Propagation (AP-SURSI), pp. 437-438, June 2016.

[7] T. G. Spence and R. Rodriguez, "Additively manufactured ultrawideband, wide scan, monolithic Vivaldi arrays," in 2017 IEEE International Symposium on Antennas and Propagation USNC/URSI National Radio Science Meeting, pp. 1239-1240, July 2017.

[8] J. Massman, B. Simpson, and T. Steffen, "Low cost additively manufactured antenna array modules," in 2019 IEEE International Symposium on Phased Array Systems and Technology (PAST), pp. 1-4, October 2019.

Figure 7:
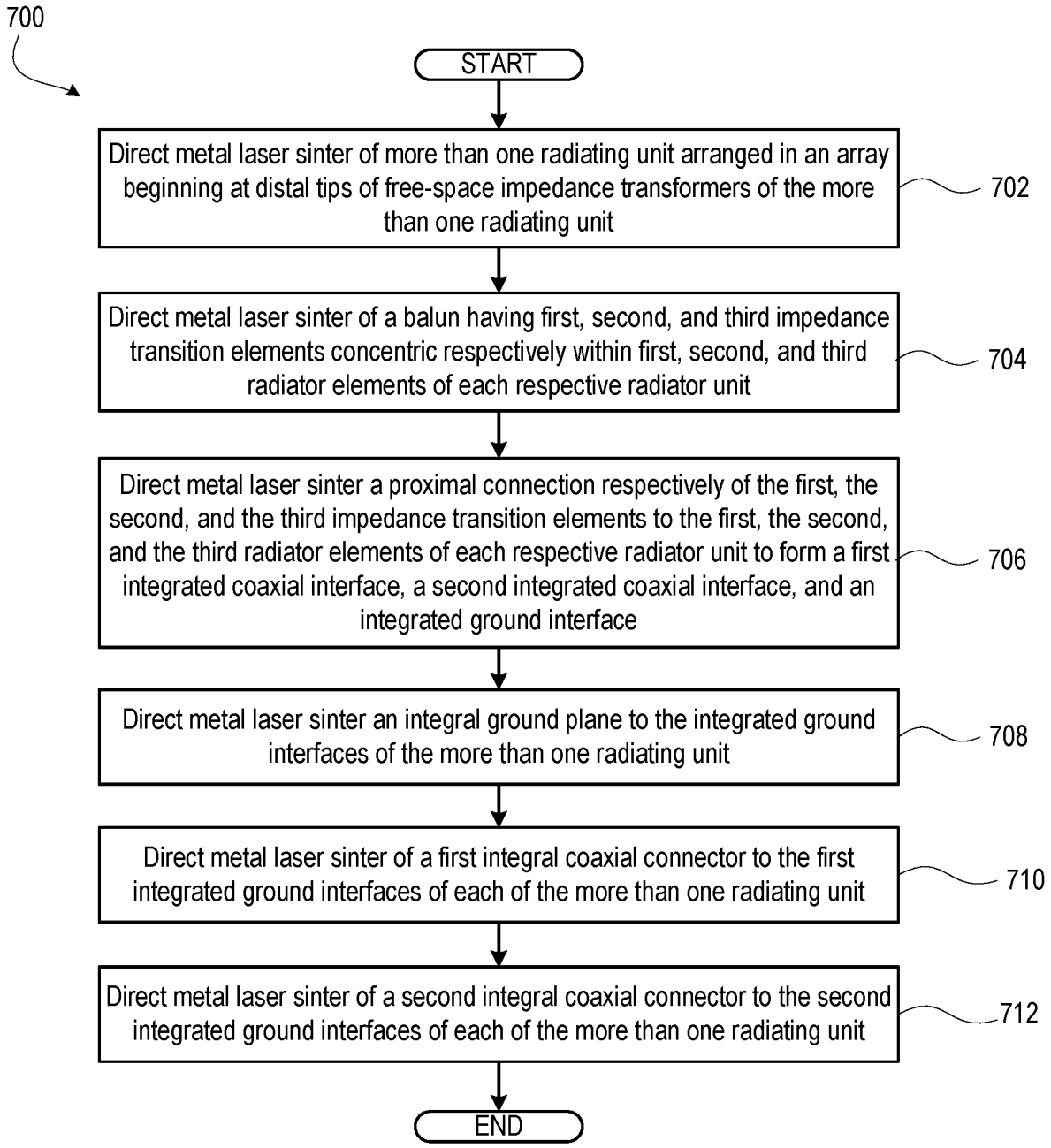
FIG. 7 presents a flow diagram of a method of making a monolithic decade-bandwidth ultra-wideband antenna array module that eliminates a need for additional support structures during additive manufacturing processes, according to one or more embodiments.

FIG. 7 presents a flow diagram of a method 700 of making a monolithic decade-bandwidth ultra-wideband antenna array module that eliminates a need for additional support structures during additive manufacturing processes. Furthermore, method 700 enables conventionally separated subsystems to be combined to achieve a lower cost, lighter weight, and faster time to market complete system. From a technical standpoint the method 700 also operates without the inclusion of secondary ground plane beneath the antenna module, though one may be added without detrimental effect. This enables the monolithic antenna module to be fabricated without additional support structures that would otherwise need to be removed by hand labor. Likewise, this design precludes the need to perform subsequent CNC machining or other post-process manufacturing steps to achieve a functional antenna array product. All other similar looking antenna disclosures require those two steps. Both of these disclosed design aspects may seem trivial at first pass to an examiner at the USPTO but significant impact the manufacturing cost and delivery timeframes.

Method 700 includes direct metal laser sintering of more than one radiating unit arranged in an array beginning at distal tips of free-space impedance transformers of the more than one radiating unit (block 702). Method 700 includes direct metal laser sintering of a balun having first, second, and third impedance transition elements concentric respectively within first, second, and third radiator elements of each respective radiator unit (block 704). Method 700 includes direct metal laser sintering a proximal connection respectively of the first, the second, and the third impedance transition elements to the first, the second, and the third radiator elements of each respective radiator unit to form a first integrated coaxial interface, a second integrated coaxial interface, and an integrated ground interface (block 706). In one or more embodiments, the first and second integrated coaxial interfaces are physically placed along adjacent sides of the phased array antenna apparatus to support orthogonal electromagnetic polarization components of a propagating signal. Method 700 includes direct metal laser sintering an integral ground plane to the integrated ground interfaces of the more than one radiating unit (block 708). Method 700 includes direct metal laser sintering of a first integral coaxial connector to the first integrated ground interfaces of each of the more than one radiating unit (block 710). Method 700 includes direct metal laser sintering of a second integral coaxial connector to the second integrated ground interfaces of each of the more than one radiating unit (block 712). Then method 700 ends.

The design and method of making are intrinsically linked in this case. The upside down fabrication as well as the self-supporting design features are both two key features. It's important to note that you cannot take an existing embodiment of a system with similar functionality and use additive manufacturing to make it without a considerable amount of follow-on manufacturing steps. Conventional antenna arrays all require subsequent manufacturing steps after additive manufacturing to achieve a fully functional system. The present innovation, however, is fully functional through just additive manufacturing.

Furthermore, the non-planar balun structure of the antenna is novel from a technical standpoint and may be considered one of the other novel features of the design.

These design features allowed us to demonstrate the first in the industry to monolithically print an entire antenna array module with embedded SMPM (also known as G2PO) RF connectors.

Industrial Applicability: The present disclosure provides a modular, end-fire, dual-polarized ultra-wideband scalable array (MEDUSA) realized exclusively with direct metal laser sintering (DMLS) to achieve a connector-less phased array antenna module. The radiator is based on a variation of conventional taper slot antennas (i.e., Vivaldi) to achieve an all metal fully-monolithic element consisting of radio frequency (RF) coaxial interface, balun, and free-space transformer. A very low-cost array module is achieved by adapting the design uniquely to the fabrication process in order to eliminate nearly all post-processing. A finite 8×8 array cover 7-21 GHz has been prototyped and measured to demonstrate agreement in active impedance and element patterns.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

In the preceding detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

1 A phased array antenna system comprising:

more than one radiating unit arranged in an array, each radiating unit comprising:

a free-space impedance transformer having first, second and third radiator elements;

an embedded balun having first, second, and third impedance transition elements located generally concentric with the first, the second, and the third radiator elements and distally connected respectively to form a first integrated coaxial interface, a second integrated coaxial interface, and an integrated ground interface; and a ground plane electrically coupled to the integrated ground interface.

2. The phased array antenna system of claim 1, wherein the first and second integrated coaxial interfaces are physically placed along adjacent sides of the phased array antenna apparatus to support orthogonal electromagnetic polarization components of a propagating signal.

3. A method comprising:

direct metal laser sintering of more than one radiating unit arranged in an array beginning at distal tips of free-space impedance transformers of the more than one radiating unit; direct metal laser sintering of a balun having first, second, and third impedance transition elements concentric respectively within first, second, and third radiator elements of each respective radiator unit;

direct metal laser sintering a proximal connection respectively of the first, the second, and the third impedance transition elements to the first, the second, and the third radiator elements of each respective radiator unit to form a first integrated coaxial interface, a second integrated coaxial interface, and an integrated ground interface; and direct metal laser sintering an integral ground plane to the integrated ground interfaces of the more than one radiating unit.

4. The method of claim 3, wherein the first and second integrated coaxial interfaces are physically placed along adjacent sides of the phased array antenna apparatus to support orthogonal electromagnetic polarization components of a propagating signal.

5. The method of claim 3, further comprising:

direct metal laser sintering of a first integral coaxial connector to the first integrated ground interfaces of each of the more than one radiating unit; and direct metal laser sintering of a second integral coaxial connector to the second integrated ground interfaces of each of the more than one radiating unit.

What is claimed is:

1. A phased array antenna system comprising:

more than one radiating unit arranged in an array, each radiating unit comprising:

a free-space impedance transformer having first, second and third radiator elements;

an embedded balun having first, second, and third impedance transition elements located generally concentric with the first, the second, and the third radiator elements and distally connected respectively to form a first integrated coaxial interface, a second integrated coaxial interface, and an integrated ground interface; and a ground plane electrically coupled to the integrated ground interface, wherein the first and second integrated coaxial interfaces are physically placed along adjacent sides of the phased array antenna apparatus to support orthogonal electromagnetic polarization components of a propagating signal.

2. A method comprising:

direct metal laser sintering of more than one radiating unit arranged in an array beginning at distal tips of free-space impedance transformers of the more than one radiating unit; direct metal laser sintering of a balun having first, second, and third impedance transition elements concentric respectively within first, second, and third radiator elements of each respective radiator unit;

direct metal laser sintering a proximal connection respectively of the first, the second, and the third impedance transition elements to the first, the second, and the third radiator elements of each respective radiator unit to form a first integrated coaxial interface, a second integrated coaxial interface, and an integrated ground interface; and direct metal laser sintering an integral ground plane to the integrated ground interfaces of the more than one radiating unit.

3. The method of claim 2, wherein the first and second integrated coaxial interfaces are physically placed along adjacent sides of the phased array antenna apparatus to support orthogonal electromagnetic polarization components of a propagating signal.

4. The method of claim 2, further comprising:

direct metal laser sintering of a first integral coaxial connector to the first integrated ground interfaces of each of the more than one radiating unit; and direct metal laser sintering of a second integral coaxial connector to the second integrated ground interfaces of each of the more than one radiating unit.

* * * * *